US011413504B2

(12) United States Patent
Sajima et al.

(10) Patent No.: US 11,413,504 B2
(45) Date of Patent: Aug. 16, 2022

(54) GOLF BALL

(71) Applicant: SUMITOMO RUBBER INDUSTRIES, LTD., Hyogo (JP)

(72) Inventors: Takahiro Sajima, Hyogo (JP); Toshiyuki Takubo, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/395,575

(22) Filed: Aug. 6, 2021

(65) Prior Publication Data

US 2022/0062710 A1 Mar. 3, 2022

(30) Foreign Application Priority Data

Aug. 26, 2020 (JP) ..... JP2020-142702

(51) Int. Cl.
*A63B 37/06* (2006.01)
*A63B 37/00* (2006.01)

(52) U.S. Cl.
CPC ..... *A63B 37/0075* (2013.01); *A63B 37/0033* (2013.01); *A63B 37/0092* (2013.01)

(58) Field of Classification Search
CPC ..... A63B 37/0038; A63B 37/004; A63B 37/0045; A63B 37/0033
USPC ..... 473/373
See application file for complete search history.

(56) References Cited

U.S. PATENT DOCUMENTS

| | | | | |
|---|---|---|---|---|
| 5,836,834 | A | 11/1998 | Masutani et al. | |
| 6,155,935 | A | 12/2000 | Maruko | |
| 6,213,893 | B1 | 4/2001 | Maruko et al. | |
| 6,398,667 | B1 * | 6/2002 | Lemons | A63B 37/12 473/376 |
| 7,326,129 | B2 * | 2/2008 | Ninomiya | A63B 37/0097 473/377 |

FOREIGN PATENT DOCUMENTS

| | | |
|---|---|---|
| JP | 9-285565 | 11/1997 |
| JP | 11-299931 | 11/1999 |
| JP | 2000-237349 | 9/2000 |

* cited by examiner

*Primary Examiner* — Raeann Gorden
(74) *Attorney, Agent, or Firm* — Greenblum & Bernstein, P.L.C.

(57) ABSTRACT

A golf ball includes a core and a cover. An n-layer (n is a natural number) partial mid layer is provided between the core and the cover. An area of the core in a region where the cover is laminated thereon is not less than 5.0% and not greater than 95.0% of a surface area of a phantom sphere. A hitting feel index Cx calculated using a thickness $T_0$ (mm) of the cover laminated on the partial mid layer, a Shore D hardness $C_k$ of a kth layer (k is an integer from 1 to n) from the core side, a thickness $T_k$ (mm) of the kth layer, a Shore D hardness C of the cover, and an average thickness T (mm) of the cover, is less than 66.0. An absolute value |Cx−C| is not less than 1.0 and not greater than 5.0.

9 Claims, 4 Drawing Sheets

2

II - II cross section

III - III cross section

IV - IV cross section

GOLF BALL

CROSS-REFERENCE TO RELATED APPLICATION

This application claims priority on and the benefit of Patent Application No. 2020-142702 filed in JAPAN on Aug. 26, 2020. The entire disclosures of this Japanese Patent Application are hereby incorporated by reference.

BACKGROUND OF THE INVENTION

Field of the Invention

The present invention relates to golf balls. Specifically, the present invention relates to golf balls having layer structures.

Description of the Related Art

In golf, a golf ball is hit with a wood type club, an iron type club, a hybrid type club (utility), a putter, or the like. The feel at impact upon hitting is an interest to golf players. Generally, golf players desire golf balls having good feel at impact.

Upon a shot with a driver, a shot with an iron, or the like, great shock is transmitted to the golf ball. Therefore, the feel at impact upon a shot with a driver, a shot with an iron, or the like is greatly affected by the degree of deformation of the golf ball due to hitting, that is, the amount of compressive deformation (compression) of the golf ball.

JPH9-285565 (Patent Literature 1) proposes a technique wherein, in a golf ball that has at least a pair of adjacent concentric solid layers having hardnesses different from each other, recesses and projections are formed on the boundary surface between the adjacent concentric solid layers, whereby different feels at impact are provided to a golf player upon an approach shot and upon a shot with a driver JPH11-299931 (Patent Literature 2) proposes a golf ball in which a large number of recesses are provided on the outer surface of a mid layer covering a core, whereby flight performance and controllability can be maintained and solid feel at impact can be obtained upon a shot with a short iron.

JP2000-237349 (Patent Literature 3) proposes a technique wherein, in a golf ball including a core, a mid layer, and a cover, a convex rib is formed in a network pattern on the surface of one of adjacent layers at a boundary portion between each layer so as to intrude into the other layer, whereby a large flight distance with a driver and good controllability and soft feel at impact with a short iron are obtained.

In each of the techniques proposed in Patent Literatures 1 to 3, the degree of deformation of the ball which receives great shock when being hit is controlled by the recess-projection structure formed inside the ball. Meanwhile, in putting, the shock transmitted to the golf ball upon hitting is very small. Therefore, the effect of the amount of compressive deformation on the feel at impact upon putting is small. The feel at impact upon putting of the golf balls proposed in Patent Literatures 1 to 3 is not yet satisfying.

In putting, even beginners often hit golf balls at the sweet spots of putters. Therefore, golf players are sensitive to the feel at impact upon putting. Even a beginner golf player can accurately judge the difference in feel at impact.

The preferred feel at impact upon putting depends on golf players. Some golf players prefer soft feel at impact, while others prefer solid feel at impact. A golf ball that meets the demands of golf players who have various tastes as described above has not yet been proposed.

An object of the present invention is to provide a golf ball that can provide feel at impact that meets a golf player's demand, upon putting.

SUMMARY OF THE INVENTION

The feel at impact upon putting is greatly affected by the hardness of the surface layer of the ball. As a result of thorough research, the present inventors have found that regions that are provided in the surface of a ball and have different hardnesses can provide different feels at impact upon putting, and have completed the present invention.

A golf ball according to the present invention includes a core and a cover positioned outside the core. An n-layer (n is a natural number) partial mid layer is provided between the core and the cover. An area of the core in a region where the cover is laminated thereon is not less than 5.0% and not greater than 95.0% of a surface area of a phantom sphere having a radius equal to an average value of a distance from a central point of the core to a surface of the core. When a thickness of the cover laminated on the partial mid layer in a region where the partial mid layer is provided is denoted by $T_0$ (mm), a Shore D hardness of a kth layer (k is an integer from 1 to n) from the core side in the partial mid layer is denoted by $C_k$, and a thickness of the kth layer is denoted by $T_k$ (mm), a hitting feel index Cx calculated by the following formula (1) is less than 66.0. An absolute value |Cx−C| of a difference between the hitting feel index Cx and a Shore D hardness C of the cover is not less than 1.0 and not greater than 5.0.

[Math. 1]

$$Cx = \left(CT_0 + \sum_{k=1}^{n} C_k T_k\right) \Big/ \left(T_0 + \sum_{k=1}^{n} T_k\right) + 10 * \left(\left(T_0 + \sum_{k=1}^{n} T_k\right) - T\right) \Big/ T \quad (1)$$

wherein T denotes an average thickness (mm) of the cover represented as a difference (Rb−Rc) between a distance Rb (mm) from the central point of the core to an outer surface of the cover and an average value Rc (mm) of the distance from the central point of the core to the surface of the core.

The golf ball according to the present invention can provide different feels at impact to a golf player depending on a location to be hit with a putter. With the golf ball, it is possible for each golf player to obtain desired feel at impact upon putting.

Preferably, the area of the core in the region where the cover is laminated thereon is not less than 50.0% and not greater than 95.0% of the surface area of the phantom sphere having a radius equal to the average value of the distance from the central point of the core to the surface of the core.

Preferably, the core is a sphere. Preferably, the partial mid layer is disposed on a spherical surface of the core.

Preferably, the Shore D hardness $C_k$ of the kth layer (k is an integer from 1 to n) from the core side in the partial mid layer is different from the Shore D hardness C of the cover. Preferably, an absolute value of a difference between the hardness $C_k$ of the kth layer and the hardness C is not less than 2.0 and not greater than 30.0.

Preferably, the partial mid layer is formed in a band shape along a great circle drawn on a surface of the golf ball. Preferably, the partial mid layer is formed in a band shape along three great circles that are drawn on a surface of the golf ball and orthogonal to each other.

Preferably, the partial mid layer is provided such that the core and the cover are in contact with each other in a band shape along a great circle drawn on a surface of the golf ball. Preferably, the partial mid layer is formed such that the core and the cover are in contact with each other in a band shape along three great circles that are drawn on a surface of the golf ball and orthogonal to each other.

DESCRIPTION OF THE PREFERRED EMBODIMENTS

Figure 1:
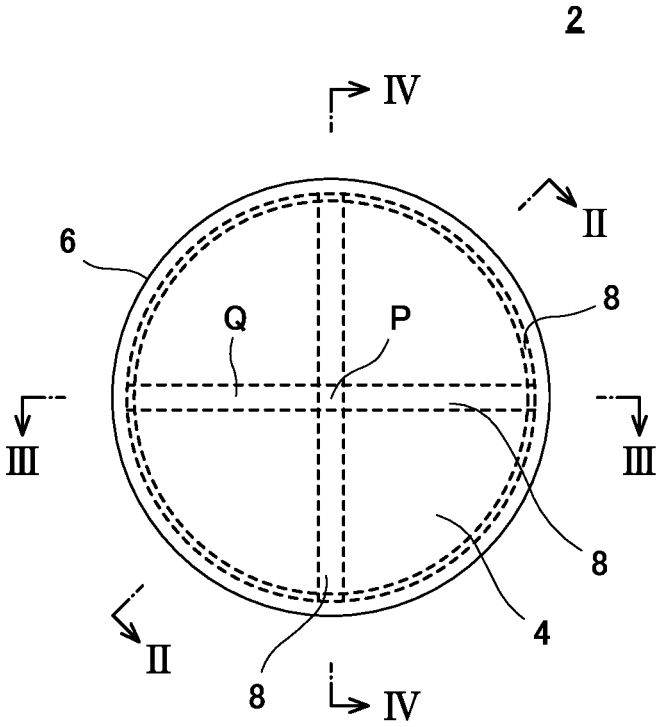
FIG. 1 is a schematic diagram showing the appearance of a golf ball according to an embodiment of the present invention.

The following will describe in detail the present invention based on preferred embodiments with appropriate reference to the drawings.

The feature of the golf ball according to the present invention is that an n-layer partial mid layer is provided between a core and a cover positioned outside the core. n is a natural number. In the specification of the present application, the term "partial mid layer" is defined as a layer that is laminated on the core and partially covers the core and on which the cover is laminated. The term "partial mid layer" in the present application is essentially different from a so-called "mid layer" that covers the entirety of the core. In the golf ball provided with the partial mid layer, a part of the cover is directly laminated on the core without the partial mid layer therebetween. The state after the partial mid layer is formed on the core and before the partial mid layer is covered with the cover is sometimes referred to as "intermediate".

In the golf ball, the ratio (hereinafter, sometimes referred to as "area %") of the area of the core in the region where the cover is directly laminated thereon, to the surface area of a phantom sphere having a radius equal to the average value of the distance from the central point of the core to the surface of the core, is not less than 5.0% and not greater than 95.0%. In the case where the area % satisfies this range, regions that provide different feels at impact can be formed on the surface of the golf ball. Furthermore, according to the golf ball in which the partial mid layer is formed such that the area % satisfies this range, a golf player can easily select a region where desired feel at impact is obtained, at the time of putting. This golf ball provides ease of hitting with a putter to the golf player.

From the viewpoint of easily obtaining different feels at impact depending on a hitting location, the ratio of the area of the core in the region where the cover is laminated thereon, to the surface area of the phantom sphere, is preferably not greater than 93.0% and more preferably not greater than 90.0%. From the same viewpoint, the area % is preferably not less than 7.0% and more preferably not less than 10.0%.

In this golf ball, in the case where the partial mid layer is provided between the core and the cover, it is necessary to insert the material of the partial mid layer between the core and a mold after the core is placed in the mold. Specifically, it is necessary to partially bring the core and the mold into close contact with each other, and insert the material of the partial mid layer only in the region where the core and the mold are not in close contact with each other. Here, if the region where the core and the mold are in close contact with each other is narrow, there is a possibility that the core cannot be stably held by the mold and a manufacturing failure may occur. In the region where the core and the mold are in close contact with each other, the partial mid layer is not formed, and the cover is formed directly on the core. That is, the area of the region where the core and the mold are in close contact with each other corresponds to the area of the region where the cover is directly laminated on the core. Therefore, from the viewpoint of avoiding the occurrence of a manufacturing failure, the ratio of the area of the core in the region where the cover is laminated thereon (that is, the area of the region where the core and the mold are in close contact with each other) to the surface area of the phantom sphere having a radius equal to the average value of the distance from the central point of the core to the surface of the core is preferably not less than 50.0%, more preferably not less than 52.0%, and further preferably not less than 55.0%.

Moreover, when a region where the partial mid layer is provided is randomly selected on a cross-section of the golf ball taken along a plane passing through the center of the golf ball, the thickness of the cover laminated on the partial mid layer is denoted by $T_0$(mm), the Shore D hardness of the kth layer (k is an integer from 1 to n) from the core side in the p-layer (n is a natural number) partial mid layer is denoted by $C_k$, and the thickness of the kth layer is denoted by $T_k$ (mm), a hitting feel index Cx calculated by the following formula (1) is less than 66.

[Math. 2]

$$Cx = \left(CT_0 + \sum_{k=1}^{n} C_k T_k\right) \Big/ \left(T_0 + \sum_{k=1}^{n} T_k\right) + 10 * \left(\left(T_0 + \sum_{k=1}^{n} T_k\right) - T\right) \Big/ T \quad (1)$$

wherein C denotes the Shore D hardness of the cover, and T denotes the average thickness (mm) of the cover represented as the difference (Rb−Rc) between a distance Rb (mm) from the central point of the core to the outer surface of the cover and an average value Rc (mm) of the distance from the central point of the core to the surface of the core.

The hitting feel index Cx is an index indicating the softness of the feel at impact obtained when a region of the golf ball where the partial mid layer is provided is hit with a putter, and is calculated for each region where the partial mid layer exists. The golf ball in which the hitting feel index Cx is less than 66.0 does not provide excessively hard feel at impact to a golf player upon putting. The feel at impact of the golf ball has moderate softness. From this viewpoint, the hitting feel index Cx is preferably less than 65.0 and more preferably less than 64.0.

Furthermore, in the golf ball, the absolute value |Cx−C| of the difference between the hitting feel index Cx obtained by the above formula (1) and the Shore D hardness C of the cover is not less than 1.0 and not greater than 5.0. In the golf ball in which the absolute value |Cx−C| is not less than 1.0, the feel at impact obtained when a golf player hits the region where the partial mid layer is formed, with a putter, and the feel at impact obtained when the golf player hits the region where the partial mid layer is not formed, with a putter, are different from each other. With this golf ball, the golf player can obtain desired feel at impact depending on a hitting location with a putter. From this viewpoint, the absolute value |Cx−C| is preferably not less than 1.5 and more preferably not less than 2.0.

In the golf ball in which the absolute value |Cx−C| is not greater than 5.0, the structure near the surface has little effect on the initial conditions of launch by clubs other than a putter. Thus, by using the absolute value |Cx−C| as an index, a golf ball that allows desired feel at impact to be selected at the time of putting without deteriorating the other ball performance is obtained. From this viewpoint, the absolute value |Cx−C| is preferably not greater than 4.5 and more preferably not greater than 4.0.

The thickness of the partial mid layer is not particularly limited, and is adjusted as appropriate such that the area %, the hitting feel index Cx, and the absolute value |Cx−C| satisfy the above-described numerical ranges. The partial mid layer may be formed of a single layer or may be formed of two or more layers. When the thickness of the kth layer (k is an integer from 1 to n) from the core side is denoted by $T_k$, from the viewpoint of ease of molding, the thickness $T_k$ is preferably not less than 0.25 mm, more preferably not less than 0.50 mm, and further preferably not less than 0.70 mm. From the viewpoint of forming a cover having an appropriate thickness and improving durability to breakage, the thickness $T_k$ is preferably not greater than 2.70 mm, more preferably not greater than 2.50 mm, and further preferably not greater than 2.30 mm. In the case where the partial mid layer is formed of two or more layers, the thicknesses of the respective layers may be equal to each other, or may be different from each other. The thickness of the partial mid layer is measured on a cross-section obtained by cutting the golf ball along a plane passing through the central point of the golf ball.

The hardness of the partial mid layer is not particularly limited, and is adjusted as appropriate such that the area %, the hitting feel index Cx, and the absolute value |Cx−C| satisfy the above-described numerical ranges. When the Shore D hardness of the kth layer (k is an integer from 1 to n) from the core side is denoted by $C_k$, from the viewpoint of durability, the Shore D hardness $C_k$ is preferably not less than 30, more preferably not less than 32, and further preferably not less than 34. From the viewpoint of obtaining soft feel at impact upon putting, the Shore D hardness $C_k$ is preferably not greater than 70, more preferably not greater than 68, and further preferably not greater than 66. In the case where the partial mid layer is formed of two or more layers, the Shore D hardnesses of the respective layers may be equal to each other, or may be different from each other. From the viewpoint of ease of molding, a partial mid layer having layers whose Shore D hardnesses are equal to each other is preferable.

The hardness of the partial mid layer is measured according to the standards of "ASTM-D 2240-68". The hardness of the partial mid layer is measured with a Shore D type hardness scale mounted to an automated hardness meter (trade name "digi test II" manufactured by Heinrich Bareiss Prüfgeratebau GmbH). For the measurement, a sheet that is formed by hot press, is formed from the same material as that of the partial mid layer, and has a thickness of about 2 mm is used. Prior to the measurement, a sheet is kept at 23° C. for two weeks. At the time of measurement, three sheets are stacked.

The average thickness T of the cover is not particularly limited, and is adjusted as appropriate such that the area %, the hitting feel index Cx, and the absolute value |Cx−C| satisfy the above-described numerical ranges. In the specification of the present application, the average thickness T of the cover is represented as the difference (Rb−Rc) between the distance Rb from the central point of the core to the outer surface of the cover and the average value Rc of the distance from the central point of the core to the surface of the core. From the viewpoint of durability, the average thickness T of the cover is preferably not less than 0.25 mm, more preferably not less than 0.50 mm, and further preferably not less than 0.70 mm. From the viewpoint of feel at impact, the average thickness T of the cover is preferably not greater than 3.0 mm, more preferably not greater than 2.8 mm, and further preferably not greater than 2.6 mm. The average thickness T of the cover is obtained from the distance Rb and the average value Rc that are measured on a cross-section obtained by cutting the golf ball along a plane passing through the central point of the golf ball. The distance Rb from the central point of the core to the outer surface of the cover is measured in a region where no dimple is formed on the outer surface of the cover.

Preferably, the thickness $T_k$ of the above-described partial mid layer is smaller than the average thickness T of the cover. From the viewpoint of ease of molding and durability, the difference $T-T_k$ between the average thickness T of the cover and the thickness $T_k$ of the partial mid layer is preferably not less than 0.25 mm, more preferably not less than 0.40 mm, and further preferably not less than 0.50 mm. The difference $T-T_k$ is preferably not greater than 2.00 mm.

The thickness $T_0$ of the cover laminated on the partial mid layer is also not particularly limited, and is adjusted as appropriate such that the area %, the hitting feel index Cx, and the absolute value |Cx−C| satisfy the above-described numerical ranges. From the viewpoint of durability, the thickness $T_0$ of the cover laminated on the partial mid layer is preferably not less than 0.25 mm, more preferably not less than 0.50 mm, and further preferably not less than 0.70 mm. From the viewpoint of feel at impact, the thickness $T_0$ is preferably not greater than 2.75 mm, more preferably not greater than 2.50 mm, and further preferably not greater than 2.30 mm. The thickness $T_0$ of the cover is measured at a position immediately below a land. In the golf ball according to the present invention, the thickness $T_0$ of the cover laminated on the partial mid layer may be uniform over the entire ball or may vary. In the case where the thickness $T_0$ of the cover varies, the measurement value obtained when the partial mid layer provided on the core is randomly selected is preferably in the above numerical range.

The hardness of the cover is not particularly limited, and is adjusted as appropriate such that the area %, the hitting feel index Cx, and the absolute value |Cx−C| satisfy the above-described numerical ranges. From the viewpoint of durability, the Shore D hardness C of the cover is preferably not less than 30, more preferably not less than 32, and further preferably not less than 34. From the viewpoint of obtaining soft feel at impact upon putting, the Shore D hardness C is preferably not greater than 70, more preferably not greater than 68, and further preferably not greater than 66. The hardness C of the cover is measured by the same method as described above for the Shore D hardness of the partial mid layer.

From the viewpoint of easily obtaining the hitting feel index Cx and the absolute value |Cx−C| that satisfy the above-described numerical ranges, a golf ball, in which the Shore D hardness $C_k$ of the kth layer (k is an integer from 1 to n) from the core side in the partial mid layer is different from the Shore D hardness C of the cover, is preferable. From this viewpoint, the absolute value of the difference between the hardness $C_k$ and the hardness C is preferably not less than 2.0 and not greater than 30.0.

The golf ball preferably has a diameter from 40 mm to 45 mm. From the viewpoint of conformity to the rules established by the United States Golf Association (USGA), the diameter is particularly preferably not less than 42.67 mm. From the viewpoint of suppression of air resistance, the diameter is more preferably not greater than 44 mm and particularly preferably not greater than 42.80 mm. The golf ball preferably has a weight of not less than 40 g and not greater than 50 g. From the viewpoint of attainment of great inertia, the weight is more preferably not less than 44 g and particularly preferably not less than 45.00 g. From the viewpoint of conformity to the rules established by the USGA, the weight is particularly preferably not greater than 45.93 g.

From the viewpoint of feel at impact, the golf ball has an amount of compressive deformation of preferably not less than 1.85 mm, more preferably not less than 2.15 mm, and particularly preferably not less than 2.30 mm. From the viewpoint of resilience performance, the amount of compressive deformation is preferably not greater than 4.85 mm, more preferably not greater than 4.55 mm, and particularly preferably not greater than 4.40 mm. For measurement of the amount of compressive deformation, a YAMADA type compression tester is used. In the tester, the golf ball is placed on a hard plate made of metal. Next, a cylinder made of metal gradually descends toward the golf ball. The golf ball, squeezed between the bottom face of the cylinder and the hard plate, becomes deformed. A migration distance of the cylinder, starting from the state in which an initial load of 98 N is applied to the golf ball up to the state in which a final load of 1274 N is applied thereto, is measured as the amount of compressive deformation.

The following will describe the present invention by exemplifying two typical embodiments, but the present invention is not limited to the following embodiments, and various modifications can be made within the scope indicated in the claims. Other embodiments obtained by appropriately combining the technical means respectively disclosed for a plurality of embodiments are also included in the technical scope of the present invention.

First Embodiment

FIG. 1 is a schematic diagram for describing a golf ball 2 according to a first embodiment of the present invention. FIG. 1 shows the appearance of the golf ball 2. The components inside the golf ball 2 are shown by broken lines. The golf ball 2 includes a core 4 and a cover 6 positioned outside the core 4. A partial mid layer 8 is provided between the core 4 and the cover 6.

Although not shown, a large number of dimples are formed on the surface of the cover 6. Of the surface of the golf ball 2, a part other than the dimples is referred to as a land. The golf ball 2 includes a paint layer and a mark layer on the external side of the cover 6, but these layers are also not shown in the drawing.

As shown, the core 4 is a sphere. In the golf ball 2, the partial mid layer 8 is formed in a band shape on the surface of the core 4 which is a sphere, and the cover 6 is laminated on the partial mid layer 8. In a region where the partial mid layer 8 is not formed, the cover 6 is directly laminated on the core 4. In the golf ball 2, the area of the core 4 in a region where the cover 6 is laminated thereon is not less than 5.0% and not greater than 95.0% of the surface area of a phantom sphere having a radius equal to the average value of the distance from the central point of the core 4 to the surface of the core 4. In the case of the core 4 which is a sphere, the area of the core 4 in the region where the cover 6 is laminated thereon is not less than 5.0% and not greater than 95.0% of the surface area of the core 4.

In the golf ball 2, the band-shaped partial mid layer 8 is formed along a great circle drawn on the surface of the golf ball 2. Specifically, the partial mid layer 8 is formed in a band shape along three great circles that are drawn on the surface of the golf ball 2 and orthogonal to each other. Here, the surface of the golf ball 2 means a spherical surface when it is postulated that no dimple is formed. In FIG. 1, symbols P and Q indicate points on one great circle, and the symbol P also indicates a point of intersection of the one great circle and another great circle.

Figure 2:
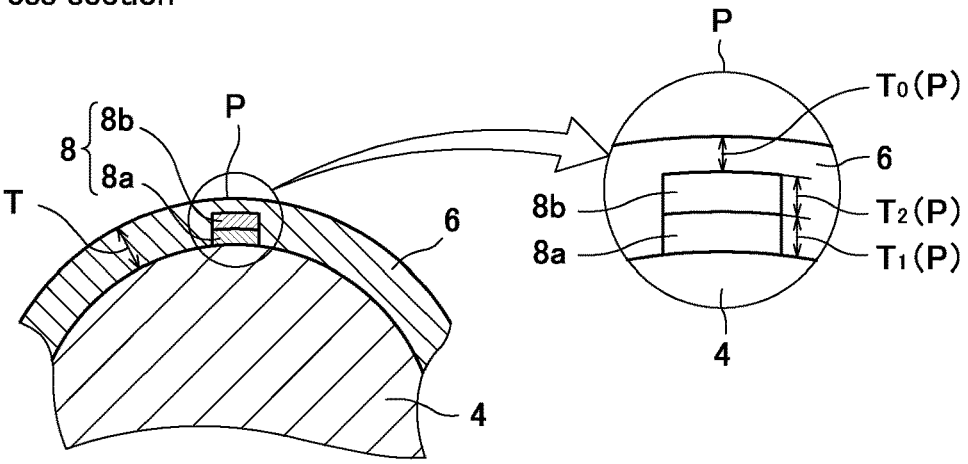
FIG. 2 is a partial cross-sectional view of the golf ball in FIG. 1 taken along a line II-II.

FIG. 2 is a partial cross-sectional view of the golf ball 2 in FIG. 1 taken along a line II-II. In FIG. 2, the average thickness (mm) of the cover 6 in the golf ball 2 is indicated as a double ended arrow T. The average thickness T of the cover 6 is the difference (Rb−Rc) between the distance Rb (mm) from the central point of the core 4 to the outer surface of the cover 6 and an average value Rc (mm) of the distance from the central point of the core 4 to the surface of the core 4. In other words, in the core 4 which is a sphere, the average value Rc (mm) of the distance from the central point of the core 4 to the surface of the core 4 is the radius of the core 4.

As shown, in a region including the point P, the partial mid layer 8 is formed. The partial mid layer 8 has two layers (n=2), and is composed of a partial mid layer **8*a* formed along the one great circle and a partial mid layer 8*b* formed along the other great circle. In a partially enlarged view near the point P shown in FIG. 2, a double ended arrow $T_0(P)$ indicates the thickness (mm) of the cover 6 laminated on the partial mid layer 8, a double ended arrow $T_1(P)$ indicates the thickness (mm) of the partial mid layer 8*a* which is the first layer from the core 4 side, and a double ended arrow $T_2(P)$ indicates the thickness (mm) of the partial mid layer 8*b* which is the second layer from the core 4 side. When a Shore D hardness C of the cover 6, a Shore D hardness $C_1$ of the partial mid layer 8*a*, and a Shore D hardness $C_2$ of the partial mid layer 8*b* are used, a hitting feel index Cx(P) calculated when the region near the point P where the partial mid layer 8 is provided is selected in the golf ball 2** is as follows.

$$Cx(P)=\{CT_0(P)+C_1T_1(P)+C_2T_2(P))\}/\{T_0(P)+T_1(P)+T_2(P)\}+10*\{(T_0(P)+T_1(P)+T_2(P)-T)\}/T$$

In the golf ball 2, the hitting feel index Cx(P) is less than 66.0, and the absolute value |Cx(P)−C| of the difference between the hitting feel index Cx(P) and the Shore D hardness C of the cover 6 is not less than 1.0 and not greater than 5.0.

Figure 3:
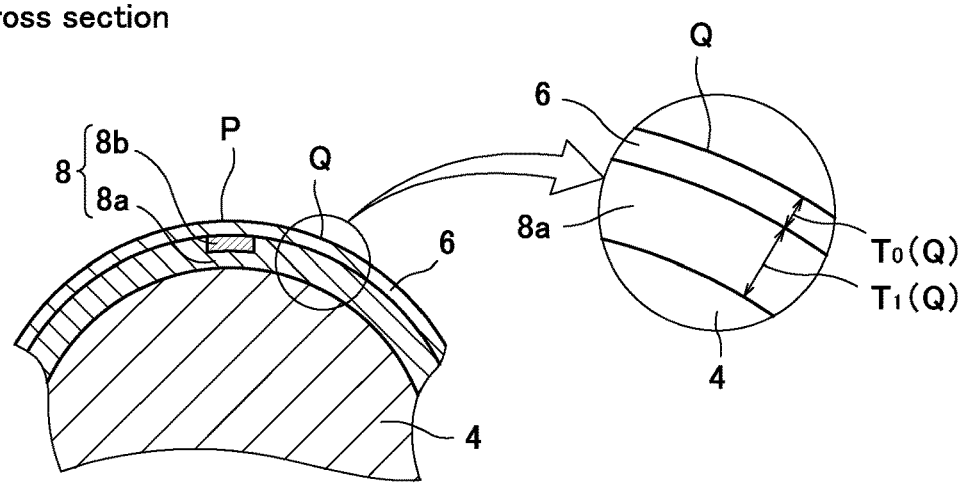
FIG. 3 is a partial cross-sectional view of the golf ball in FIG. 1 taken along a line III-III.

FIG. 3 is a partial cross-sectional view of the golf ball 2 in FIG. 1 taken along a line III-III. As shown, in the golf ball 2, the partial mid layer **8*a* is formed along the great circle including the points P and Q in FIG. 1. In the region including the point P, the two-layer (n=2) partial mid layer 8 is formed as described above. The partial mid layer 8***a* formed in a region other than the region including the point P has one layer (n=1).

In a partially enlarged view near the point Q shown in FIG. 3, a double ended arrow $T_0(Q)$ indicates the thickness (mm) of the cover 6 laminated on the partial mid layer 8*a*, and a double ended arrow $T_1(Q)$ indicates the thickness (mm) of the partial mid layer 8*a* which is the first layer. When the Shore D hardness C of the cover 6 and the Shore D hardness $C_1$ of the partial mid layer 8*a* which is the first layer from the core 4 side are used, a hitting feel index Cx(Q) calculated when the region near the point Q where the partial mid layer 8*a* is provided is selected in the golf ball 2 is as follows.

$$Cx(Q)=\{CT_0(Q)+C_1T_1(Q))\}/\{T_0(Q)+T_1(Q)\}+10*\{(T_0(Q)+T_1(Q)-T)\}/T$$

In the golf ball 2, the hitting feel index Cx(Q) is less than 66.0, and the absolute value |Cx(Q)−C| of the difference between the hitting feel index Cx(Q) and the Shore D hardness C of the cover 6 is not less than 1.0 and not greater than 5.0. The hitting feel index Cx(P) calculated for the region including the point P is as described above.

Figure 4:
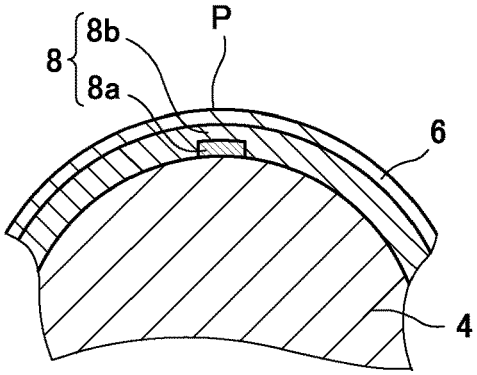
FIG. 4 is a partial cross-sectional view of the golf ball in FIG. 1 taken along a line IV-IV.

FIG. 4 is a partial cross-sectional view of the golf ball 2 in FIG. 1 taken along a line IV-IV. As shown, in the golf ball 2, the partial mid layer 8*b* is formed along a great circle including the point P in FIG. 1. In the region including the point P, the above-described two-layer (n=2) partial mid layer 8 is formed. The hitting feel index Cx(P) calculated for the region including the point P is as described above. The partial mid layer 8*b* formed in a region other than the region including the point P has one layer (n=1). The hitting feel index Cx calculated for the region where the partial mid layer 8*b* having one layer is formed is as described above for the region including the point Q in FIG. 2.

The following will sequentially describe preferable configurations and materials of the core 4, the cover 6, and the partial mid layer 8, but as long as the object of the present invention is achieved, these layers may be formed from other materials, and the golf ball 2 may further include another layer.

In the golf ball 2, the core 4 may be formed from a resin composition, or may be formed from a rubber composition. Preferably, the core 4 is formed by crosslinking a rubber composition. Examples of the base rubber of the rubber composition include polybutadienes, polyisoprenes, styrene-butadiene copolymers, ethylene-propylene-diene copolymers, and natural rubbers. From the viewpoint of resilience performance, polybutadienes are preferable. Preferably, a co-crosslinking agent is used for crosslinking. Preferably, the rubber composition includes an organic peroxide together with a co-crosslinking agent.

As long as the advantageous effects of the present invention are not impaired, the core 4 may be formed from a composition further including additives such as a filler, sulfur, a vulcanization accelerator, a sulfur compound, an anti-aging agent, a coloring agent, a plasticizer, a dispersant, and the like. The composition forming the core 4 may include synthetic resin powder or crosslinked rubber powder. In the case where the appearance of the golf ball 2 is white, a typical coloring agent is titanium dioxide.

As long as the area %, the hitting feel index Cx, and the absolute value |Cx−C| satisfy the above-described numerical ranges, the core 4 is not limited to a sphere, and recesses and projections may be formed on the surface of the core 4. The recesses and projections formed on the surface of the core 4 can contribute to improvement of the degree of freedom in design by fitting the partial mid layer and the cover to each other. From the viewpoint of ease of molding, the core 4 is preferably a sphere. The core 4 may have two or more layers. In the case of a multilayer core, the materials of the respective layers may be the same or different from each other.

As long as the advantageous effects of the present invention are achieved, the size of the core 4 is not particularly limited. In the case where the core 4 is a sphere, from the viewpoint of ease of molding and ball performance other than feel at impact, the diameter of the core 4 is preferably not less than 35.0 mm and not greater than 42.0 mm. In the case where the core 4 has recesses and projections on the surface thereof, the average value Rc of the distance from the central point of the core 4 to the surface of the core 4 is preferably not less than 35.0 mm and not greater than 42.0 mm.

The difference Hs−Hc of a Shore C hardness Hs at the surface of the core 4 and a Shore C hardness Hc at the central point of the core 4 is not particularly limited, but from the viewpoint of ball performance such as resilience performance, spin performance, and the like, the difference Hs−Hc is preferably not less than 5, more preferably not less than 10, and further preferably not less than 20. From the viewpoint of ease of production, this difference is preferably not greater than 40.

The hardness Hs and the hardness Hc are measured with a Shore C type hardness scale mounted to an automated hardness meter (trade name "digi test II" manufactured by Heinrich Bareiss Prüfgeratebau GmbH). The hardness Hc is measured by pressing the hardness scale against the central point of the cross-section of a hemisphere obtained by cutting the golf ball 2. The hardness Hs is measured by pressing this hardness meter against the surface of the core 4. Both measurements are conducted in an environment of 23° C.

The method for producing the core 4 is not particularly limited. For example, a method is used in which the above-described rubber composition is kneaded with a known kneader (for example, a Banbury mixer, a kneader, a roll, or the like), then the obtained kneaded product is placed into a core mold, and injection molding or compression molding is performed. The temperature for crosslinking the core 4 is preferably not lower than 140° C. and not higher than 180° C. The time period for crosslinking the core 4 is preferably not shorter than 10 minutes and not longer than 60 minutes. The weight of the core 4 thus obtained is preferably not less than 10 g and not greater than 42 g.

The partial mid layer 8 is positioned outside the core 4. The partial mid layer 8 partially covers the outer surface of the core 4. In the golf ball 2, the partial mid layer 8 may be formed from a resin composition, or may be formed from a rubber composition. From the viewpoint of ease of production, the partial mid layer 8 is preferably formed from a resin composition.

A thermoplastic resin or a thermosetting resin can be used as a base resin for the partial mid layer 8. Typical resins are ionomer resins or polyurethanes. Ionomer resins are more preferable.

Specific examples of ionomer resins include: trade names "Himilan #1555", "Himilan #1557", "Himilan #1605", "Himilan #1706", "Himilan #1707", "Himilan #1856", "Himilan #1855", "Himilan AM7337", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names "Surlyn #6120", "Surlyn #6910", "Surlyn #7930", "Surlyn #7940", "Surlyn #8140", "Surlyn #8150", "Surlyn #8940", "Surlyn #8945", "Surlyn #9120", "Surlyn #9150", "Surlyn #9910", "Surlyn #9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

Preferably, the resin composition of the partial mid layer 8 further includes a styrene block-containing thermoplastic elastomer. Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Furthermore, styrene block-containing thermoplastic elastomers include a polymer alloy of an olefin and one or more members selected from the group consisting of SBS, SIS, and SIBS, and hydrogenated products thereof.

Specific examples of polymer alloys include trade names "TEFABLOC T3221C", "TEFABLOC T3339C", "TEFABLOC SJ4400N", "TEFABLOC SJ5400N", "TEFABLOC SJ6400N", "TEFABLOC SJ7400N", "TEFABLOC SJ8400N", "TEFABLOC SJ9400N", and "TEFABLOC SR04", manufactured by Mitsubishi Chemical Corporation. Other specific examples of styrene block-containing thermoplastic elastomers include trade name "Epofiiend A1010" manufactured by Daicel Corporation, and trade name "SEPTON HG-252" manufactured by Kuraray Co., Ltd.

Preferably, the resin composition of the partial mid layer 8 includes a coloring agent. For example, in the golf ball 2 in which the cover 6 is formed to be transparent or in a light color, the color of the partial mid layer 8 including the coloring agent is reflected in the outer surface of the golf ball 2. As described above, the golf ball 2 can provide different feels at impact to a golf player depending on a hitting location upon putting. With the golf ball 2 in which the color of the partial mid layer 8 is reflected in the outer surface of the golf ball 2, a golf player can select a hitting location at which desired feel at impact is obtained, using the color of the partial mid layer 8 as an index. Unless the advantageous effects of the present invention are impaired, the resin composition forming the partial mid layer 8 may include a filler, a dispersant, an antioxidant, an ultraviolet absorber, a light stabilizer, a fluorescent material, a fluorescent brightener, and the like in an adequate amount.

As long as the area %, the hitting feel index Cx, and the absolute value $|Cx-C|$ satisfy the above-described numerical ranges, the shape and the number of partial mid layers 8 are not particularly limited. One partial mid layer 8 may be formed so as to partially cover the core 4, or two or more partial mid layers 8 partially covering the core 4 may be formed without being in contact with each other. For example, a plurality of partial mid layers 8 may be formed in a band shape along a great circle drawn on the surface of the golf ball 2 and a plurality of small circles parallel to the great circle. In addition, a partial mid layer 8 may be formed in a band shape along three great circles that are drawn on the surface of the golf ball 2 and orthogonal to each other as shown in FIG. 1, may be formed in a band shape along two great circles randomly selected from among these three great circles, or may be formed in a band shape along one great circle randomly selected from among these three great circles. From the viewpoint of ease of production and durability to breakage, the partial mid layer 8 laminated on the core 4 is preferably connected integrally.

Moreover, in the case where the partial mid layer 8 is formed in a band shape as shown in FIG. 1, a width h of the band shape is adjusted as appropriate such that the area % satisfies the above-described numerical range. From the viewpoint of easily obtaining an appropriate area %, the width h is preferably not less than 0.5 mm and not greater than 10.0 mm.

The method for forming the partial mid layer 8 on the core 4 is not particularly limited, and known methods such as injection molding, compression molding, and the like can be used. An example of the method is as follows. A mold that includes upper and lower mold halves each having a substantially hemispherical cavity having a projection formed on an inner wall thereof, is prepared, and the core 4 is placed in the mold such that the projection on the cavity inner wall is in close contact with the surface of the core 4. Thereafter, the resin composition of the partial mid layer 8 heated at a predetermined temperature is injection-molded around the core 4.

Preferably, the cover 6 is formed from a resin composition. Examples of the base resin of the resin composition of the cover 6 include ionomer resins, polystyrenes, polyesters, polyamides, polyolefins, and polyurethanes. The base resin is preferably an ionomer resin. The ionomer resin described above for the partial mid layer 8 can be used. For the cover 6, an ionomer resin and another resin may be used in combination.

The resin composition of the cover 6 may include a coloring agent. However, in the case where the partial mid layer 8 includes a coloring agent, the cover 6 is preferably formed to be transparent or in a light color. In the golf ball 2, the color of the partial mid layer 8 is reflected in the surface of the golf ball 2. In the golf ball 2, a golf player can easily grasp regions providing different feels at impact, owing to the formation of the partial mid layer 8. The resin composition of the cover 6 may further include a filler, a dispersant, an antioxidant, an ultraviolet absorber, a light stabilizer, a fluorescent material, a fluorescent brightener, and the like.

The method for forming the cover 6 on an intermediate consisting of the core 4 and the partial mid layer 8 is not particularly limited, and known methods such as injection molding, compression molding, and the like can be used. Normally, during molding of the cover 6, dimples are formed by pimples formed on the cavity face of a mold.

Second Embodiment

Figure 5:
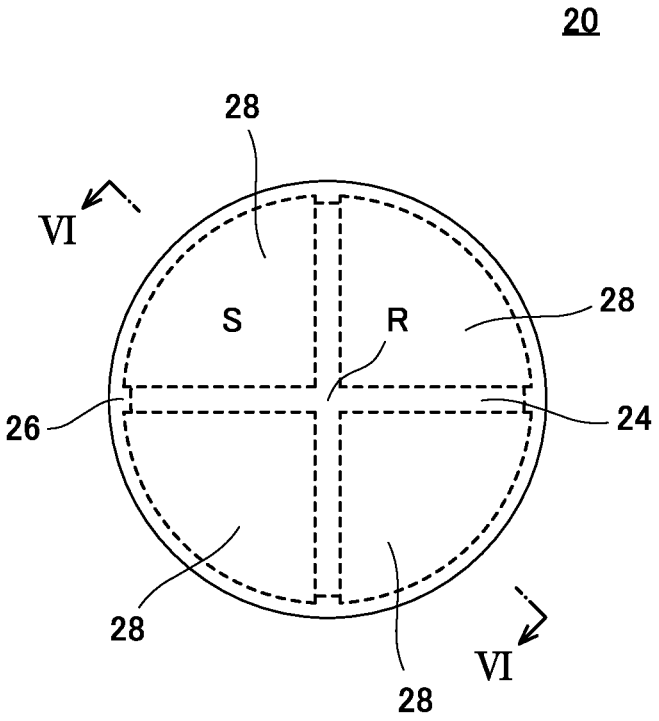
FIG. 5 is a schematic diagram showing the appearance of a golf ball according to another embodiment of the present invention.

FIG. 5 is a schematic diagram for describing a golf ball 20 according to a second embodiment of the present invention. FIG. 5 shows the appearance of the golf ball 20. The components inside the golf ball 20 are shown by broken lines. The golf ball 20 includes a core 24 and a cover 26 positioned outside the core 24. A partial mid layer 28 is provided between the core 24 and the cover 26.

Although not shown, a large number of dimples are formed on the surface of the cover 26. Of the surface of the golf ball 20, a part other than the dimples is referred to as a land. The golf ball 20 includes a paint layer and a mark layer on the external side of the cover 26, but these layers are also not shown in the drawing.

As shown, the core 24 is a sphere. In the golf ball 20, the partial mid layer 28 is formed on the surface of the core 24 which is a sphere, and the cover 26 is laminated on the partial mid layer 28. In a band-shaped region where the partial mid layer 28 is not formed, the cover 26 is directly laminated on the core 24. In the golf ball 20, the area of the core 24 in a region where the cover 26 is laminated thereon is not less than 5.0% and not greater than 95.0% of the surface area of a phantom sphere having a radius equal to the average value of the distance from the central point of the core 24 to the surface of the core 24.

In the golf ball 20, the partial mid layer 28 is provided such that the core 24 and the cover 26 are in contact with each other in a band shape along a great circle drawn on the surface of the golf ball 20. Specifically, the partial mid layer 28 is formed such that the core 24 and the cover 26 are in contact with each other in a band shape along three great circles that are drawn on the surface of the golf ball 20 and orthogonal to each other. Here, the surface of the golf ball 20 means a spherical surface when it is postulated that no dimple is formed. In FIG. 5, a symbol R indicates a point of intersection of one great circle and another great circle, and a symbol S indicates a region where the partial mid layer 28 is provided.

Figure 6:
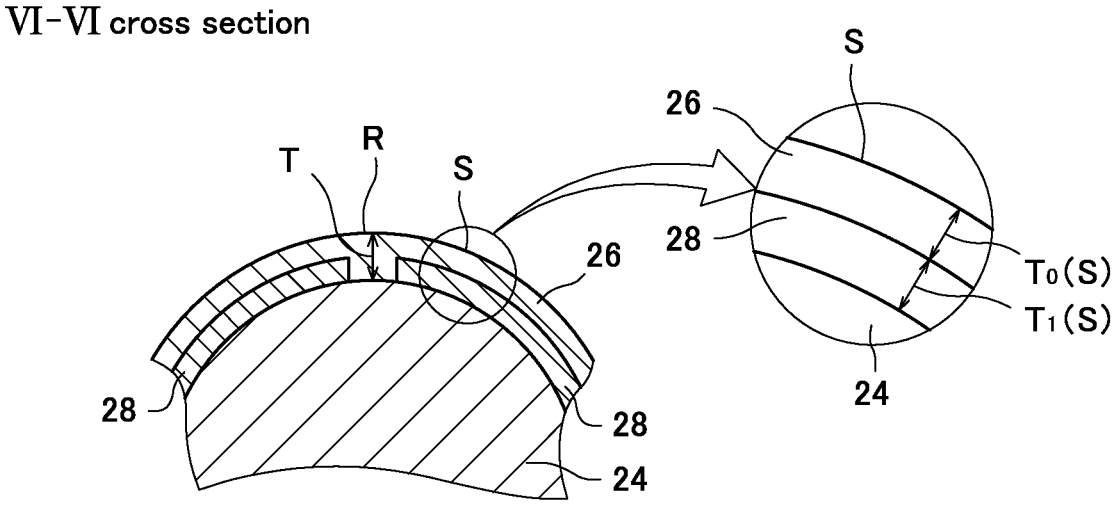
FIG. 6 is a partial cross-sectional view of the golf ball in FIG. 5 taken along a line VI-VI.

FIG. 6 is a partial cross-sectional view of the golf ball 20 in FIG. 5 taken along a line VI-VI. A double ended arrow T shown in FIG. 6 indicates the average thickness (mm) of the cover 26 in the golf ball 20. The average thickness T of the cover 26 is defined as the difference (Rb−Rc) between a distance Rb (mm) from the central point of the core 24 to the outer surface of the cover 26 and an average value Rc (mm) of the distance from the central point of the core 24 to the surface of the core 24. In other words, in the core 24 which is a sphere, the average value Rc (mm) of the distance from the central point of the core 24 to the surface of the core 24 is the radius of the core 24.

As shown, in the golf ball 20, the partial mid layer 28 is not formed in a region including the point R in FIG. 6. In this region, the cover 26 is directly laminated on the core 24. In the region shown as the region S in FIG. 6, the one-layer (n=1) partial mid layer 28 is provided between the core 24 and the cover 26.

In a partially enlarged view of the region S shown in FIG. 6, a double ended arrow $T_0(S)$ indicates the thickness (mm) of the cover 26 laminated on the partial mid layer 28, and a double ended arrow $T_1(S)$ indicates the thickness (mm) of the partial mid layer 28 which is the first layer from the core 24 side. When a Shore D hardness C of the cover 26 and a Shore D hardness $C_1$ of the partial mid layer 28 which is the first layer from the core 24 side are used, a hitting feel index Cx(S) calculated when the region S where the partial mid layer 28 is provided is selected in the golf ball 20 is as follows.

$$Cx(S)=\{CT_0(S)+C_1T_1(S))\}/\{T_0(S)+T_1(S)\}+10*\{(T_0(S)+T_1(S)-T)\}/T$$

In the golf ball 20, the hitting feel index Cx(S) is less than 66.0, and the absolute value |Cx(S)−C| of the difference between the hitting feel index Cx(S) and the Shore D hardness C of the cover 26 is not less than 1 and not greater than 5. The hitting feel index Cx(P) calculated for the region including the point P is as described above.

For preferable configurations and materials of the core 24 and the cover 26, the configurations and the materials described above in the first embodiment can be applied.

In the golf ball 20, the partial mid layer 28 is positioned outside the core 24. In the golf ball 20, a part of the outer surface of the core 24 is not covered with the partial mid layer 28. The partial mid layer 28 may be formed from a resin composition, or may be formed from a rubber composition. From the viewpoint of ease of production, the partial mid layer 28 is preferably formed from a resin composition. The resin composition described above in the first embodiment can be used.

As long as the area %, the hitting feel index Cx, and the absolute value |Cx−C| satisfy the above-described numerical ranges, the shape of the region where the partial mid layer 28 is not formed and the cover 26 is directly laminated on the core 24 is not particularly limited. For example, the partial mid layer 28 may be formed such that the cover 26 is directly laminated on the core 24 in a plurality of band-shaped regions along a great circle drawn on the surface of the golf ball 20 and a plurality of small circles parallel to the great circle. In addition, the partial mid layer 28 may be formed such that the core 24 and the cover 26 are in contact with each other in a band shape along three great circles that are drawn on the surface of the golf ball 20 and orthogonal to each other as shown in FIG. 5, may be formed such that the core 24 and the cover 26 are in contact with each other in a band shape along two great circles randomly selected from among these three great circles, or may be formed such that the core 24 and the cover 26 are in contact with each other in a band shape along one great circle randomly selected from among these three great circles.

Moreover, in the case where the core 24 and the cover 26 are formed so as to be in contact with each other in a band shape as shown in FIG. 5, the width of the region having the band shape is adjusted as appropriate such that the area % satisfies the above-described numerical range. From the viewpoint of easily obtaining an appropriate area %, the width is preferably not less than 0.5 mm and not greater than 10.0 mm.

EXAMPLES

The following will show the advantageous effects of the present invention by means of Examples, but the present invention should not be construed in a limited manner on the basis of the description of these Examples.

Example 1

A rubber composition was obtained by kneading 100 parts by weight of a high-cis polybutadiene (trade name "BR-730", manufactured by JSR Corporation), an appropriate amount of zinc diacrylate (trade name "SANCELER SR", manufactured by SANSHIN CHEMICAL INDUSTRY CO., LTD.), 5 parts by weight of zinc oxide (trade name "Zinc Oxide", manufactured by Mitsui Mining & Smelting Co., Ltd.), an appropriate amount of barium sulfate (trade name "Barium Sulfate BD", manufactured by Sakai Chemical Industry Co., Ltd.), 0.5 parts by weight of diphenyl disulfide (manufactured by Sumitomo Seika Chemicals Co., Ltd.), and 0.9 parts by weight of dicumyl peroxide (trade name "PERCUMYL D", manufactured by NOF Corporation). This rubber composition was placed into a mold including upper and lower mold halves each having a hemispherical cavity, and heated at 170° C. for 18 minutes to obtain a spherical core having a diameter of 38.7 mm. The amount of zinc diacrylate was adjusted such that a golf ball having a certain compression (amount of compressive deformation: 3.05 mm, Atti: about 80) was obtained. The amount of barium sulfate was adjusted such that a golf ball having a certain weight (45.5 g) was obtained. The difference between the Shore C hardness at the surface of the core and the Shore C hardness at the central point of the core was 20.

A resin composition a having a Shore D hardness of 57 was obtained by kneading 47 parts by weight of an ionomer resin (the aforementioned "Himilan #1555"), 46 parts by weight of another ionomer resin (the aforementioned "Himilan #1557"), 7 parts by weight of a styrene block-containing thermoplastic elastomer (the aforementioned "TEFABLOC T3221C"), 4 parts by weight of titanium dioxide (trade name "TIPAQUE A-220", manufactured by ISHIHARA SANGYO KAISHA, LTD.), and 0.2 parts by weight of a light stabilizer (trade name "JF-90", manufactured by Johoku Chemical Co., Ltd.) with a twin-screw kneading extruder.

Next, a mold that includes upper and lower mold halves each having a substantially hemispherical cavity was prepared. The cavity had grooves formed with a uniform depth on a wall surface thereof along three great circles that are drawn on the surface of a sphere formed when the upper and lower mold halves are combined and that are orthogonal to each other. The obtained core was placed in the mold, and then the resin composition a was injected into the grooves of the cavity, thereby forming a partial mid layer having a thickness of 0.50 mm and a width of 2.0 mm. This partial mid layer was composed of one layer, and was formed along three great circles that are drawn on the spherical surface of the core and orthogonal to each other.

A resin composition b having a Shore D hardness of 63 was obtained by kneading 40 parts by weight of an ionomer resin (the aforementioned "Himilan AM7329"), 20 parts by weight of another ionomer resin (the aforementioned "Himilan #1605"), 40 parts by weight of still another ionomer resin (the aforementioned "Himilan #1555"), 4 parts by weight of titanium dioxide (the aforementioned "TIPAQUE A-220"), and 0.2 parts by weight of a light stabilizer (the aforementioned "JF-90") with a twin-screw kneading extruder.

An intermediate consisting of the core and the partial mid layer was placed into a mold that includes upper and lower mold halves each having a substantially hemispherical cavity. The intermediate was covered with the resin composition b by injection molding to form a cover. The average thickness of the cover was 2.00 mm. The thickness of the cover laminated on the partial mid layer was 1.50 mm. On the cover, dimples having a shape that is the inverted shape of pimples were formed.

A clear paint including a two-component curing type polyurethane as a base material was applied to this cover to form a paint layer and obtain a golf ball of Example 1 having a diameter of about 42.7 mm and a weight of about 45.5 g. The details of the golf ball are shown in Table 1 below. In Table 1, the pattern of the formed partial mid layer on a cut surface of the golf ball passing through the central point of the golf ball and points corresponding to points of intersection of the respective great circles is shown as Type B. A schematic diagram for describing Type B is shown in FIG. 7B.

FIG. 7 shows partial cross-sectional views of golf balls on cross-sections of the golf balls taken along planes passing through the central points of the golf balls. In FIG. 7, the up-down direction is the radial direction, and the right-left direction is a substantially circumferential direction. In FIG. 7, the dimples and the paint layer formed on the cover are not shown. FIG. 7B shows the golf ball according to the above-described first embodiment, and the partial mid layer 8 is provided between the spherical core 4 and the cover 6 as shown. In FIG. 7B, a double ended arrow T indicates the average thickness of the cover 6, a double ended arrow $T_0$ indicates the thickness of the cover 6 laminated on the partial mid layer 8, and a double ended arrow $T_1$ indicates the thickness of the partial mid layer 8. The width of the partial mid layer 8 is shown as a width h (mm) in Table 1.

Examples 2 to 5, 13, 14, 18, and 19 and Comparative Examples 1 and 8

Golf balls of Examples 2 to 5, 13, 14, 18, and 19 and Comparative Examples 1 and 8 were obtained in the same manner as Example 1, except the specifications of the partial mid layer and the cover were as shown in Tables 1, 4, and 6 below. The details of each golf ball are shown in Tables 1, 4, and 6 below. The pattern of the formed partial mid layer on a cut surface of the golf ball passing through the central point of the golf ball and points corresponding to points of intersection of the respective great circles is shown as Type B. A schematic diagram for describing Type B is shown in FIG. 7B. In Tables 1, 4, and 6, the width h shown for each of Examples 2 to 5, 13, 14, 18, and 19 and Comparative Examples 1 and 8 is the width (mm) of the partial mid layer formed in a band shape.

Example 17

A spherical core having a diameter of 38.7 mm and a resin composition a having a Shore D hardness of 57 were prepared in the same manner as Example 1. Subsequently, a resin composition c having a Shore D hardness of 60 was obtained by kneading 50 parts by weight of an ionomer resin (the aforementioned "Himilan #1555"), 49 parts by weight of another ionomer resin (the aforementioned "Himilan #1557"), 1 part by weight of a styrene block-containing thermoplastic elastomer (the aforementioned "TEFABLOC T3221C"), 4 parts by weight of titanium dioxide (the aforementioned "TIPAQUE A-220"), and 0.2 parts by weight of a light stabilizer (the aforementioned "JF-90") with a twin-screw kneading extruder.

Next, a mold that includes upper and lower mold halves each having a substantially hemispherical cavity was prepared. The cavity had grooves formed with a uniform depth on three great circles that are drawn on the surface of a sphere formed when the upper and lower mold halves are combined and that are orthogonal to each other. The obtained core was placed in the mold. Thereafter, the resin composition a was put into two grooves formed on the cavity, and then the resin composition c was injected into the other one groove, thereby forming a partial mid layer having a width of 6.0 mm.

On the core, a partial mid layer (a) made of the resin composition a was formed along two great circles that are drawn on the spherical surface of the core and orthogonal to each other, and a partial mid layer (c) made of the resin composition c was formed along one great circle orthogonal to these two great circles. In a region where the partial mid layer (a) and the partial mid layer (c) intersect each other, a two-layer (n=2) partial mid layer (ac) in which the partial mid layer (c) having a thickness of 0.50 mm is laminated on the partial mid layer (a) having a thickness of 0.50 mm, was formed. The thicknesses of the partial mid layers (a) and (c) in a region where both layers do not intersect each other were each 1.00 mm.

Next, a resin composition b having a Shore D hardness of 63 was prepared in the same manner as Example 1, and an intermediate consisting of the core and the partial mid layer was covered with this resin composition b by injection molding to form a cover. The average thickness T of the cover was 2.00 mm. The thickness $T_0$ of the cover laminated on the partial mid layer was 1.00 mm.

A clear paint including a two-component curing type polyurethane as a base material was applied to this cover to obtain a golf ball of Example 17 having a diameter of about 42.7 mm and a weight of about 45.5 g. The details of the golf ball are shown in Table 5 below. The pattern of the formed partial mid layer on a cut surface of the golf ball passing through the central point of the golf ball and points corresponding to points of intersection of the respective great circles is shown as Type B. A schematic diagram for describing Type B is shown in FIG. 7B. In the region shown in FIG. 7B, the partial mid layer (a) and the partial mid layer (c) do not intersect each other. In Table 5, the width h shown for Example 17 is the width (mm) of each partial mid layer formed in a band shape, a hitting feel index Cx and an absolute value |Cx−C| are values calculated for each of the regions where the partial mid layer (a), the partial mid layer (c), and the partial mid layer (ac) exist.

Examples 7 to 9 and 12 and Comparative Examples 4 to 6

In Examples 7 to 9 and 12 and Comparative Examples 4 to 6, first, a core having a recess on the surface thereof was formed in the same manner as Example 1, except a mold that includes upper and lower mold halves each having a substantially hemispherical cavity having a projection formed with a uniform height (0.6 mm) on three great circles that are drawn on the surface of a sphere formed when the upper and lower mold halves are combined and that are orthogonal to each other, was used. The average value of the distance from the central point of the core to the surface of the core was 19.35 mm. The amount of zinc diacrylate was adjusted such that a golf ball having a certain compression (amount of compressive deformation: 3.05 mm, Atti: about 80) was obtained. The amount of barium sulfate was adjusted such that a golf ball having a certain weight (45.5 g) was obtained. The difference between the Shore C hardness at the surface of the core and the Shore C hardness at the central point of the core was 20.

Next, golf balls of Examples 7 to 9 and 12 and Comparative Examples 4 to 6 were obtained in the same manner as Example 1, except the specifications of the partial mid layer and the cover were as shown in Tables 2 and 3 below, and a mold that includes upper and lower mold halves each having a substantially hemispherical cavity having a groove formed with a uniform depth at a position corresponding to the recess of the core, was used. The average thickness T of the cover in each of these golf balls was 2.00 mm. The details of each golf ball are shown in Tables 2 and 3 below. The pattern of the formed partial mid layer on a cut surface of the golf ball passing through the central point of the golf ball and points corresponding to points of intersection of the respective great circles is shown as Type A. A schematic diagram for describing Type A is shown in FIG. 7A.

Figure 7A:
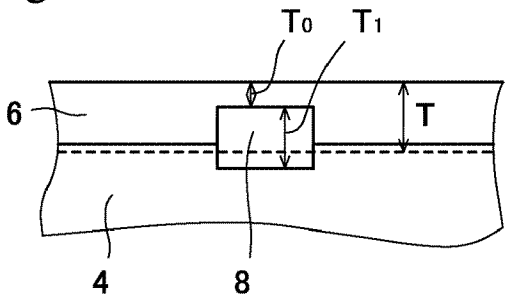
FIGS. 7A to 7F are schematic diagrams for describing the arrangements of partial mid layers in Examples and Comparative Examples.
Figure 7B:
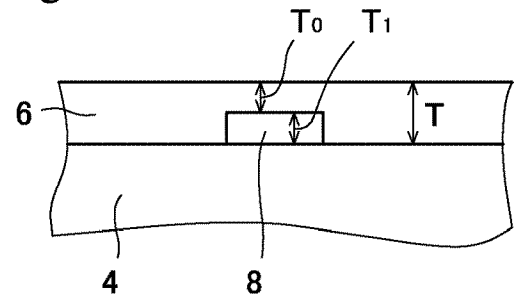

In FIG. 7A, a recess is provided on the spherical core in the golf ball according to the above-described first embodiment. As shown, in these golf balls, the partial mid layer 8 is provided between the core 4 having a recess and the cover 6. In FIG. 7A, the surface of a phantom sphere having a radius equal to the average value of the distance between the central point of the core 4 and the surface of the core 4 is indicated by a broken line. In FIG. 7A, a double ended arrow T indicates the average thickness of the cover 6, a double ended arrow $T_0$ indicates the thickness of the cover 6 laminated on the partial mid layer 8, and a double ended arrow $T_1$ indicates the thickness of the partial mid layer 8. In Tables 2 and 3, the width h shown for each of Examples 7 to 9 and 12 and Comparative Examples 4 to 6 is the width (mm) of the partial mid layer 8 formed in a band shape.

Examples 6, 10, and 11 and Comparative Examples 2 and 3

In Examples 6, 10, and 11 and Comparative Examples 2 and 3, first, a core having a projection on the surface thereof was formed in the same manner as Example 1, except a mold that includes upper and lower mold halves each having a substantially hemispherical cavity having a recess formed with a uniform depth (0.6 mm) on three great circles drawn on the surface of a sphere formed when the upper and lower mold halves are combined and that are orthogonal to each other, was used. The average value of the distance from the central point of the core to the surface of the core was 19.35 mm. The amount of zinc diacrylate was adjusted such that a golf ball having a certain compression (amount of compressive deformation: 3.05 mm, Atti: about 80) was obtained. The amount of barium sulfate was adjusted such that a golf ball having a certain weight (45.5 g) was obtained. The difference between the Shore C hardness at the surface of the core and the Shore C hardness at the central point of the core was 20.

Next, golf balls of Examples 6, 10, and 11 and Comparative Examples 2 and 3 were obtained, using a mold that includes upper and lower mold halves each having a substantially hemispherical cavity having a groove formed with a uniform depth at a position corresponding to the projection of the core, such that the specifications of the partial mid layer and the cover were as shown in Tables 2 and 3 below. The average thickness T of the cover in each of these golf balls was 2.00 mm. The details of each golf ball are shown in Tables 2 and 3 below. In Tables 2 and 3, the pattern of the formed partial mid layer on a cut surface of the golf ball passing through the central point of the golf ball and points corresponding to points of intersection of the respective great circles is shown as Type C. A schematic diagram for describing Type C is shown in FIG. 7C.

Figure 7C:
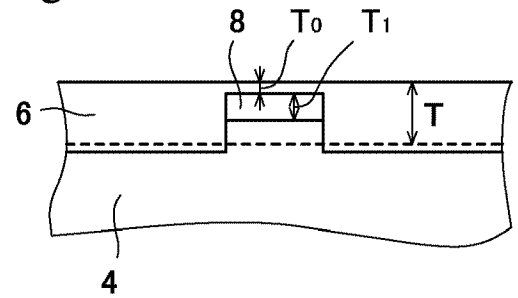

In FIG. 7C, a projection is provided on the spherical core in the golf ball according to the above-described first embodiment. As shown, in these golf balls, the partial mid layer 8 is provided between the core 4 having a projection and the cover 6. In FIG. 7C, the surface of a phantom sphere having a radius equal to the average value of the distance between the central point of the core 4 and the surface of the core 4 is indicated by a broken line. A double ended arrow T indicates the average thickness of the cover 6, a double ended arrow $T_0$ indicates the thickness of the cover 6 laminated on the partial mid layer 8, and a double ended arrow $T_1$ indicates the thickness of the partial mid layer 8. In Tables 2 and 3, the width h shown for each of Examples 6, 10, and 11 and Comparative Examples 2 and 3 is the width (mm) of the partial mid layer 8 formed in a band shape.

Example 16

A spherical core having a diameter of 38.7 mm and a resin composition a having a Shore D hardness of 57 were prepared in the same manner as Example 1.

Next, a mold that includes upper and lower mold halves each having a substantially hemispherical cavity was prepared. The cavity had a projection formed with a uniform height on a wall surface thereof along three great circles that are drawn on the surface of a sphere formed when the upper and lower mold halves are combined and that are orthogonal to each other. The obtained core was placed in the mold. Thereafter, the resin composition a was put into a portion other than the projection of the cavity, thereby forming a partial mid layer having a thickness of 1.00 mm. The partial mid layer was composed of one layer, and was formed such that the surface of the core was exposed in a band shape with a width of 2.0 mm along three great circles that are drawn on the spherical surface of the core and orthogonal to each other.

Subsequently, a resin composition b having a Shore D hardness of 63 was prepared in the same manner as Example 1, and an intermediate consisting of the core and the partial mid layer was covered with this resin composition b by injection molding to form a cover. The cover was formed such that the cover was directly laminated on the core in a band-shaped region having a width of 2.0 mm and formed along the three great circles that are drawn on the spherical surface of the core and orthogonal to each other. The average thickness T of the cover was 2.00 mm. The thickness $T_0$ of the cover laminated on the partial mid layer was 1.00 mm.

A clear paint including a two-component curing type polyurethane as a base material was applied to this cover to obtain a golf ball of Example 16 having a diameter of about 42.7 mm and a weight of about 45.5 g. The details of the golf ball are shown in Table 4 below. In Table 4, the pattern of the formed partial mid layer on a cut surface of the golf ball passing through the central point of the golf ball and points corresponding to points of intersection of the respective great circles is shown as Type E. A schematic diagram for describing Type E is shown in FIG. 7E.

Figure 7D:
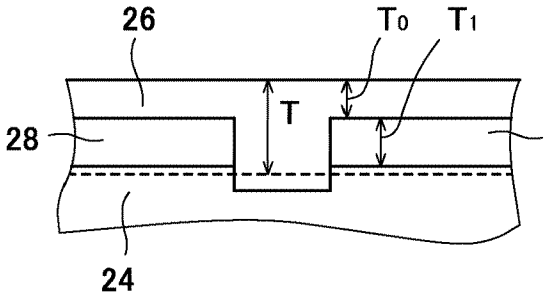
Figure 7E:
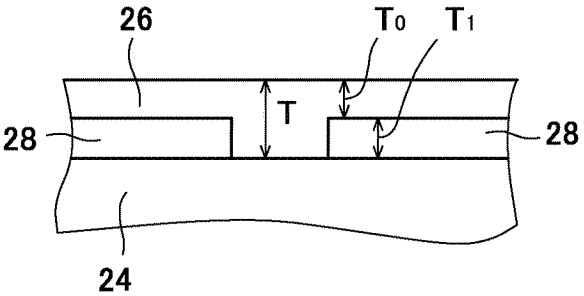

FIG. 7E shows the golf ball according to the above-described second embodiment, and the partial mid layer 28 is provided between the spherical core 24 and the cover 26 as shown. In FIG. 7E, a double ended arrow T indicates the average thickness of the cover 26, a double ended arrow $T_0$ indicates the thickness of the cover 26 laminated on the partial mid layer 28, and a double ended arrow $T_1$ indicates the thickness of the partial mid layer 28. The width of the band-shaped region where the partial mid layer 28 is not formed on the core 24 and the core 24 and the cover 26 are in contact with each other is shown as a width h (mm) in Table 4.

Example 20 and Comparative Example 9

Golf balls of Example 20 and Comparative Example 9 were obtained in the same manner as Example 16, except the specifications of the partial mid layer and the cover were as shown in Tables 4 and 6 below. The details of each golf ball are shown in Tables 4 and 6 below. In Tables 4 and 6, the pattern of the formed partial mid layer on a cut surface of the golf ball passing through the central point of the golf ball and points corresponding to points of intersection of the respective great circles is shown as Type E. A schematic diagram for describing Type E is shown in FIG. 7E. In Tables 4 and 6, the width h (mm) shown for each of Example 20 and Comparative Example 9 is the width of the band-shaped region where the partial mid layer 28 is not formed and the core 24 and the cover 26 are in contact with each other.

Example 15

A core having a recess on the surface thereof was prepared in the same manner as Examples 7 to 9 and 12 and Comparative Examples 4 to 6. The average value of the distance from the central point of the core to the surface of the core was 19.35 mm. The amount of zinc diacrylate was adjusted such that a golf ball having a certain compression (amount of compressive deformation: 3.05 mm, Atti: about 80) was obtained. The amount of barium sulfate was adjusted such that a golf ball having a certain weight (45.5 g) was obtained. The difference between the Shore C hardness at the surface of the core and the Shore C hardness at the central point of the core was 20.

Next, a resin composition a having a Shore D hardness of 57 was prepared in the same manner as Example 1. Subsequently, a golf ball of Example 15 was obtained in the same manner as Example 16, except the specifications of the partial mid layer and the cover were as shown in Table 4 below, and a mold that includes upper and lower mold halves each having a substantially hemispherical cavity having a projection formed with a uniform height at a position corresponding to the recess of the core, was used. The average thickness T of the cover in the golf ball was 2.50 mm. The thickness $T_0$ of the cover laminated on the partial mid layer was 1.00 mm. The details of the golf ball are shown in Table 4 below. In Table 4, the pattern of the formed partial mid layer on a cut surface of the golf ball passing through the central point of the golf ball and points corresponding to points of intersection of the respective great circles is shown as Type D. A schematic diagram for describing Type D is shown in FIG. 7D.

In FIG. 7D, a recess is provided on the spherical core in the golf ball according to the above-described second embodiment. As shown, in the golf ball, the partial mid layer 28 is provided between the core 24 having a recess and the cover 26. In FIG. 7D, the surface of a phantom sphere having a radius equal to the average value of the distance between the central point of the core 24 and the surface of the core 24 is indicated by a broken line. A double ended arrow T indicates the average thickness of the cover 26, a double ended arrow $T_0$ indicates the thickness of the cover 26 laminated on the partial mid layer 28, and a double ended arrow $T_1$ indicates the thickness of the partial mid layer 28. In Table 4, the width h (mm) shown for Example 15 is the width of the band-shaped region where the partial mid layer 28 is not formed and the core 24 and the cover 26 are in contact with each other.

Comparative Example 7

A core having a projection on the surface thereof was prepared in the same manner as Examples 6, 10, and 11 and Comparative Examples 2 and 3. The average value of the distance from the central point of the core to the surface of the core was 19.35 mm. The amount of zinc diacrylate was adjusted such that a golf ball having a certain compression (amount of compressive deformation: 3.05 mm, Atti: about 80) was obtained. The amount of barium sulfate was adjusted such that a golf ball having a certain weight (45.5 g) was obtained. The difference between the Shore C hardness at the surface of the core and the Shore C hardness at the central point of the core was 20.

Next, a resin composition a having a Shore D hardness of 57 was prepared in the same manner as Example 1. Subsequently, a golf ball of Comparative Example 7 was obtained in the same manner as Example 16, except the specifications of the partial mid layer and the cover were as shown in Table 4 below, and a mold that includes upper and lower mold halves each having a substantially hemispherical cavity having a projection formed with a uniform height at a position corresponding to the projection of the core, was used. The average thickness T of the cover in the golf ball was 1.50 mm. The thickness $T_0$ of the cover laminated on the partial mid layer was 1.00 mm. The details of the golf ball are shown in Table 4 below. In Table 4, the pattern of the formed partial mid layer on a cut surface of the golf ball passing through the central point of the golf ball and points corresponding to points of intersection of the respective great circles is shown as Type F. A schematic diagram for describing Type F is shown in FIG. 7F.

Figure 7F:
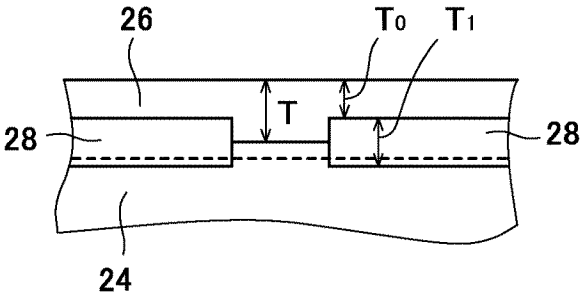

In FIG. 7F, a projection is provided on the spherical core in the golf ball according to the above-described second embodiment. As shown, in the golf ball, the partial mid layer 28 is provided between the core 24 having a projection and the cover 26. In FIG. 7F, the surface of a phantom sphere having a radius equal to the average value of the distance between the central point of the core 24 and the surface of the core 24 is indicated by a broken line. A double ended arrow T indicates the average thickness of the cover 26, a double ended arrow $T_0$ indicates the thickness of the cover 26 laminated on the partial mid layer 28, and a double ended arrow $T_1$ indicates the thickness of the partial mid layer 28. In Table 4, the width h (mm) shown for Comparative Example 7 is the width of the band-shaped region where the partial mid layer 28 is not formed and the core 24 and the cover 26 are in contact with each other.

Reference Example

A golf ball of a reference example including a spherical core having a diameter of 38.7 mm and a cover having a thickness of 2.00 mm was obtained in the same manner as Example 1, except no partial mid layer was formed. The golf ball of the reference example was used as a control for the following evaluation tests.

[Putting Test]

On each of the surfaces of the golf balls of Examples 1 to 20 and Comparative Examples 1 to 9, an identification line was added to indicate the boundary between the region where the partial mid layer is formed and the region where the partial mid layer is not formed. These golf balls were hit by each of 30 golf players on a flat grass with a putter toward a hit target 5 times. Thereafter, evaluation was made on a 6-point scale by the 30 golf players for each of the following items (1) to (3).

(1) Whether there is a difference in feel at impact depending on the partial mid layer (Yes: 5 points to No: 0 points)

(2) Whether there is a part (soft part) having different feel at impact in each ball (Yes: 5 points to No: 0 points)

(3) Whether it is easy to hit (easy to hit: 5 points to difficult to hit: 0 points) The results obtained by categorization made according to the following criteria on the basis of the average values obtained for the respective items are shown as "difference in hitting feel", "softness", and "ease of hitting" in Tables 1 to 6 below.

A: not less than 4.0 points

B: not less than 2.5 points and less than 4.0 points

C: not less than 1.0 point and less than 2.5 points

D: less than 1.0 point

[Wedge Test]

A wedge (trade name "558 RTX2.0 Tour Satin Wedge", manufactured by Cleveland Golf Company, Inc., shaft hardness: S, loft angle: 52 degrees) was attached to a swing machine manufactured by Golf Laboratories, Inc. The golf balls of Examples 1 to 20, Comparative Examples 1 to 9, and the reference example were hit under a condition of a head speed of 16 m/s, and the spin rates (rpm) thereof were measured. The measurement was performed by hitting an arbitrary point on each golf ball. The average of values obtained from 24 measurements was obtained, and the results obtained by the following categorization made on the basis of the difference in spin rate between each of the golf balls of Examples 1 to 20 and Comparative Examples 1 to 9 and the golf ball of the reference example are shown as "spin difference" in Tables 1 to 6 below.

A: less than 100 rpm

B: not less than 100 rpm and less than 200 rpm

C: not less than 200 rpm and less than 500 rpm

D: not less than 500 rpm

[Moldability]

For each of Examples 1 to 20 and Comparative Examples 1 to 9, 120 golf balls were molded by injection molding. The evaluation was categorized as follows on the basis of the number of golf balls for which molding failure occurred, out of the 120 golf balls. The results are shown as "ease of molding" in Tables 1 to 6 below. The molding failure defect means that the partial mid layer was not able to be formed at a desired position with a desired thickness.

A: 0

B: 1

C: 2

D: 3 or more

TABLE 1

| | | Comp. Ex. 1 | Ex. 1 | Ex. 2 | Ex. 3 | Ex. 4 | Ex. 5 |
|---|---|---|---|---|---|---|---|
| Area % | [%] | 85.0 | 85.0 | 85.0 | 85.0 | 85.0 | 85.0 |
| Partial mid layer | | | | | | | |
| Type | [—] | B | B | B | B | B | B |
| Width h | [mm] | 2.0 | 2.0 | 2.0 | 2.0 | 2.0 | 2.0 |
| $T_1$ | [mm] | 0.25 | 0.50 | 0.75 | 1.00 | 1.25 | 1.50 |
| $C_1$ | (Shore D) | 57 | 57 | 57 | 57 | 57 | 57 |
| $T_2$ | [mm] | — | — | — | — | — | — |
| $C_2$ | (Shore D) | — | — | — | — | — | — |
| Cover | | | | | | | |
| T | [mm] | 2.00 | 2.00 | 2.00 | 2.00 | 2.00 | 2.00 |
| $T_0$ | [mm] | 1.75 | 1.50 | 1.25 | 1.00 | 0.75 | 0.50 |
| C | (Shore D) | 63 | 63 | 63 | 63 | 63 | 63 |
| Cx | [—] | 62.3 | 61.5 | 60.8 | 60.0 | 59.3 | 58.5 |
| \|Cx − C\| | [—] | 0.8 | 1.5 | 2.3 | 3.0 | 3.8 | 4.5 |

TABLE 1-continued

| | | Comp. Ex. 1 | Ex. 1 | Ex. 2 | Ex. 3 | Ex. 4 | Ex. 5 |
|---|---|---|---|---|---|---|---|
| Putting | | | | | | | |
| Difference in hitting feel | [—] | D | B | A | A | A | A |
| Softness | [—] | B | B | B | B | A | A |
| Ease of hitting | [—] | A | A | A | A | A | A |
| Wedge | | | | | | | |
| Spin difference | [—] | A | A | A | A | B | B |
| Ease of molding | [—] | A | A | A | A | A | A |

TABLE 2

| | | Comp. Ex. 2 | Ex. 6 | Comp. Ex. 3 | Comp. Ex. 4 | Comp. Ex. 5 | Ex. 7 |
|---|---|---|---|---|---|---|---|
| Area % | [%] | 85.0 | 85.0 | 85.0 | 85.0 | 85.0 | 85.0 |
| Partial mid layer | | | | | | | |
| Type | [—] | C | C | C | A | A | A |
| Width h | [mm] | 2.0 | 2.0 | 2.0 | 2.0 | 2.0 | 2.0 |
| $T_1$ | [mm] | 0.50 | 0.50 | 1.00 | 1.00 | 1.25 | 1.50 |
| $C_1$ | (Shore D) | 57 | 57 | 57 | 57 | 57 | 57 |
| $T_2$ | [mm] | — | — | — | — | — | — |
| $C_2$ | (Shore D) | — | — | — | — | — | — |
| Cover | | | | | | | |
| T | [mm] | 2.00 | 2.00 | 2.00 | 2.00 | 2.00 | 2.00 |
| $T_0$ | [mm] | 0.50 | 1.00 | 0.50 | 1.50 | 1.25 | 1.00 |
| C | (Shore D) | 63 | 63 | 63 | 63 | 63 | 63 |
| Cx | [—] | 55.0 | 58.5 | 56.5 | 63.1 | 62.5 | 61.9 |
| \|Cx − C\| | [—] | 8.0 | 4.5 | 6.5 | 0.1 | 0.5 | 1.1 |
| Putting | | | | | | | |
| Difference in hitting feel | [—] | A | A | A | D | D | C |
| Softness | [—] | A | A | A | B | B | B |
| Ease of hitting | [—] | A | A | A | A | A | A |
| Wedge | | | | | | | |
| Spin difference | [—] | D | B | D | A | A | A |
| Ease of molding | [—] | A | A | A | A | A | A |

TABLE 3

| | | Ex. 8 | Ex. 9 | Comp. Ex. 6 | Ex. 10 | Ex. 11 | Ex. 12 |
|---|---|---|---|---|---|---|---|
| Area % | [%] | 85.0 | 85.0 | 85.0 | 85.0 | 85.0 | 85.0 |
| Partial mid layer | | | | | | | |
| Type | [—] | A | A | A | C | C | A |
| Width h | [mm] | 2.0 | 2.0 | 2.0 | 2.0 | 2.0 | 2.0 |
| $T_1$ | [mm] | 2.00 | 1.50 | 1.00 | 0.50 | 0.50 | 1.00 |
| $C_1$ | (Shore D) | 57 | 57 | 57 | 63 | 63 | 63 |
| $T_2$ | [mm] | — | — | — | — | — | — |
| $C_2$ | (Shore D) | — | — | — | — | — | — |
| Cover | | | | | | | |
| T | [mm] | 2.00 | 2.00 | 2.00 | 2.00 | 2.00 | 2.00 |
| $T_0$ | [mm] | 1.00 | 1.50 | 2.00 | 0.50 | 1.00 | 1.50 |
| C | (Shore D) | 63 | 63 | 63 | 63 | 63 | 63 |
| Cx | [—] | 64.0 | 65.0 | 66.0 | 58.0 | 60.5 | 65.5 |
| \|Cx − C\| | [—] | 1.0 | 2.0 | 3.0 | 5.0 | 2.5 | 2.5 |

TABLE 3-continued

| | | Ex. 8 | Ex. 9 | Comp. Ex. 6 | Ex. 10 | Ex. 11 | Ex. 12 |
|---|---|---|---|---|---|---|---|
| Putting | | | | | | | |
| Difference in hitting feel | [—] | C | A | A | A | A | A |
| Softness | [—] | B | C | D | A | B | C |
| Ease of hitting | [—] | A | A | A | A | A | A |
| Wedge | | | | | | | |
| Spin difference | [—] | A | B | C | C | B | B |
| Ease of molding | [—] | A | A | A | A | A | A |

TABLE 4

| | | Ex. 13 | Ex. 14 | Ex. 15 | Ex. 16 | Comp. Ex. 7 |
|---|---|---|---|---|---|---|
| Area % | [%] | 64.4 | 52.0 | 15.0 | 15.0 | 15.0 |
| Partial mid layer | | | | | | |
| Type | [—] | B | B | D | E | F |
| Width h | [mm] | 5.0 | 7.0 | 2.0 | 2.0 | 2.0 |
| $T_1$ | [mm] | 1.00 | 1.00 | 1.00 | 1.00 | 1.00 |
| $C_1$ | (Shore D) | 57 | 57 | 57 | 57 | 57 |
| $T_2$ | [mm] | — | — | — | — | — |
| $C_2$ | (Shore D) | — | — | — | — | — |
| Cover | | | | | | |
| T | [mm] | 2.00 | 2.00 | 2.50 | 2.00 | 1.50 |
| $T_0$ | [mm] | 1.00 | 1.00 | 1.00 | 1.00 | 1.00 |
| C | (Shore D) | 63 | 63 | 63 | 63 | 63 |
| Cx | [—] | 60.0 | 60.0 | 58.0 | 60.0 | 63.3 |
| \|Cx − C\| | [—] | 3.0 | 3.0 | 5.0 | 3.0 | 0.3 |
| Putting | | | | | | |
| Difference in hitting feel | [—] | A | A | A | A | D |
| Softness | [—] | B | B | C | B | B |
| Ease of hitting | [—] | A | A | A | A | A |
| Wedge | | | | | | |
| Spin difference | [—] | A | A | C | A | A |
| Ease of molding | [—] | A | B | C | C | C |

TABLE 5

| | | Ex. 17 | | |
|---|---|---|---|---|
| Area % | [%] | | 58.1 | |
| Partial mid layer | | (a) | (c) | (ac) |
| Type | [—] | | B | |
| Width h | [mm] | 6.0 | 6.0 | 6.0 |
| $T_1$ | [mm] | 1.00 | 1.00 | 0.50 |
| $C_1$ | (Shore D) | 57 | 60 | 57 |
| $T_2$ | [mm] | — | — | 0.50 |
| $C_2$ | (Shore D) | — | — | 60 |
| Cover | | | | |
| T | [mm] | | 2.00 | |
| $T_0$ | [mm] | 1.00 | 1.00 | 1.00 |
| C | (Shore D) | | 63 | |
| Cx | [—] | 60.0 | 61.5 | 60.8 |
| \|Cx − C\| | [—] | 3.0 | 1.5 | 2.3 |

TABLE 5-continued

| | | Ex. 17 |
|---|---|---|
| Putting | | |
| Difference in hitting feel | [—] | A |
| Softness | [—] | B |
| Ease of hitting | [—] | A |
| Wedge | | |
| Spin difference | [—] | A |
| Ease of molding | [—] | A |

TABLE 6

| | | Comp. Ex. 8 | Ex. 18 | Ex. 19 | Ex. 20 | Comp. Ex. 9 |
|---|---|---|---|---|---|---|
| Area % | [%] | 95.4 | 92.4 | 88.7 | 7.6 | 4.6 |
| Partial mid layer | | | | | | |
| Type | [—] | B | B | B | E | E |
| Width h | [mm] | 0.6 | 1.00 | 1.50 | 1.00 | 0.60 |
| $T_1$ | [mm] | 1.00 | 1.00 | 1.00 | 1.00 | 1.00 |
| $C_1$ | (Shore D) | 57 | 57 | 57 | 57 | 57 |
| $T_2$ | [mm] | — | — | — | — | — |
| $C_2$ | (Shore D) | — | — | — | — | — |
| Cover | | | | | | |
| T | [mm] | 2.00 | 2.00 | 2.00 | 2.00 | 2.00 |
| $T_0$ | [mm] | 1.00 | 1.00 | 1.00 | 1.00 | 1.00 |
| C | (Shore D) | 63 | 63 | 63 | 63 | 63 |
| Cx | [—] | 60.0 | 60.0 | 60.0 | 60.0 | 60.0 |
| \|Cx − C\| | [—] | 3.0 | 3.0 | 3.0 | 3.0 | 3.0 |
| Putting | | | | | | |
| Difference in hitting feel | [—] | A | A | A | A | A |
| Softness | [—] | B | B | B | B | B |
| Ease of hitting | [—] | D | C | B | C | D |
| Wedge | | | | | | |
| Spin difference | [—] | A | A | A | A | A |
| Ease of molding | [—] | A | A | A | C | D |

In Tables 1 to 6, the area % means the ratio (%) of the area of the core in the region where the cover is directly laminated thereon to the surface area of a phantom sphere having a radius equal to the average value of the distance from the central point of the core to the surface of the core. Types A to F indicate the arrangement patterns of the cores, the partial mid layers, and the covers schematically shown as (A) to (F) in FIG. 7. In the case of Examples 1 to 14 and 17 to 19 and Comparative Examples 1 to 6 and 8 (Types A to C), the width h means the width (mm) of each partial mid layer formed in a band shape, and, in the case of Examples 15, 16, and 20 and Comparative Examples 7 and 9 (Types D to F), the width h means the width (mm) of the band-shaped region where the partial mid layer is not formed and the core and the cover are in direct contact with each other.

The results are as follows. From Tables 1 to 6, it is confirmed that the golf balls of Examples 1 to 20 are golf balls with which desired feel at impact is easily obtained upon putting and whose spin performance upon a shot with a wedge is not impaired. On the other hand, in Comparative Examples 1, 4, 5, and 7 in which the absolute value |Cx−C| is less than 1, the difference in feel at impact due to the presence/absence of the partial mid layer was small. In Comparative Examples 2 and 3 in which the absolute value |Cx−C| exceeds 5, spin performance upon a shot with a wedge was impaired. In Comparative Example 6 in which the hitting feel index Cx is 66, soft feel at impact was not obtained. In Comparative Example 8 in which the area (area %) of the core on which the cover is directly laminated exceeds 95.0% and in Comparative Example 9 in which the area % is less than 5.0%, it was difficult to hit the golf ball since the region where desired feel at impact is obtained was small.

As shown in Tables 1 to 6, the golf balls of the Examples are highly rated as compared to the golf balls of the Comparative Examples. From the evaluation results, advantages of the present invention are clear.

The golf ball described above can be used for playing golf on golf courses and practicing at practice ranges.

The above descriptions are merely illustrative examples, and various modifications can be made without departing from the principles of the present invention.

What is claimed is:

1. A golf ball comprising a core and a cover positioned outside the core, wherein an n-layer (n is a natural number) partial mid layer is provided between the core and the cover, an area of the core in a region where the cover is laminated thereon is not less than 5.0% and not greater than 95.0% of a surface area of a phantom sphere having a radius equal to an average value of a distance from a central point of the core to a surface of the core, and when a thickness of the cover laminated on the partial mid layer in a region where the partial mid layer is provided is denoted by $T_0$ (mm), a Shore D hardness of a kth layer (k is an integer from 1 to n) from the core side in the partial mid layer is denoted by $C_k$, and a thickness of the kth layer is denoted by $T_k$ (mm), a hitting feel index Cx calculated by the following formula (1) is less than 66.0, and an absolute value |Cx−C| of a difference between the hitting feel index Cx and a Shore D hardness C of the cover is not less than 1.0 and not greater than 5.0,

[Math. 1]

$$Cx = \left(CT_0 + \sum_{k=1}^{n} C_k T_k\right) \Big/ \left(T_0 + \sum_{k=1}^{n} T_k\right) + 10 * \left(\left(T_0 + \sum_{k=1}^{n} T_k\right) - T\right) \Big/ T \quad (1)$$

wherein T denotes an average thickness (mm) of the cover represented as a difference (Rb−Rc) between a distance Rb (mm) from the central point of the core to an outer surface of the cover and an average value Rc (mm) of the distance from the central point of the core to the surface of the core.

2. The golf ball according to claim 1, wherein the area of the core in the region where the cover is laminated thereon is not less than 50.0% and not greater than 95.0% of the surface area of the phantom sphere having a radius equal to the average value of the distance from the central point of the core to the surface of the core.

3. The golf ball according to claim 1, wherein the core is a sphere, and the partial mid layer is disposed on a spherical surface of the core.

4. The golf ball according to claim 1, wherein the Shore D hardness $C_k$ of the kth layer (k is an integer from 1 to n) from the core side in the partial mid layer is different from the Shore D hardness C of the cover.

5. The golf ball according to claim 4, wherein an absolute value of a difference between the hardness $C_k$ and the hardness C is not less than 2.0 and not greater than 30.0.

6. The golf ball according to claim 1, wherein the partial mid layer is formed in a band shape along a great circle drawn on a surface of the golf ball.

7. The golf ball according to claim 1, wherein the partial mid layer is formed in a band shape along three great circles that are drawn on a surface of the golf ball and orthogonal to each other.

8. The golf ball according to claim 1, wherein the partial mid layer is provided such that the core and the cover are in contact with each other in a band shape along a great circle drawn on a surface of the golf ball.

9. The golf ball according to claim 1, wherein the partial mid layer is formed such that the core and the cover are in contact with each other in a band shape along three great circles that are drawn on a surface of the golf ball and orthogonal to each other.

* * * * *